US010012949B1

(12) United States Patent
Itabashi

(10) Patent No.: US 10,012,949 B1
(45) Date of Patent: Jul. 3, 2018

(54) DEVELOPING CARTRIDGE CAPABLE OF DETECTING SPECIFICATION THEREOF

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/716,016

(22) Filed: Sep. 26, 2017

(30) Foreign Application Priority Data

Dec. 28, 2016 (JP) ..... 2016-256209

(51) Int. Cl.
*G03G 15/08* (2006.01)
*G03G 21/18* (2006.01)
*G03G 21/16* (2006.01)

(52) U.S. Cl.
CPC ..... *G03G 21/1814* (2013.01); *G03G 15/0832* (2013.01); *G03G 21/1892* (2013.01); *G03G 21/1896* (2013.01); *G03G 15/0806* (2013.01); *G03G 21/1647* (2013.01); *G03G 21/1652* (2013.01); *G03G 21/1825* (2013.01)

(58) Field of Classification Search
USPC ..... 399/107, 110, 111, 113, 119, 252, 258, 399/262
See application file for complete search history.

(56) References Cited

U.S. PATENT DOCUMENTS 5,749,031 A * 5/1998 Miwa ..... G03G 15/0126 399/228
9,429,877 B2 * 8/2016 Sato ..... G03G 21/1825
2008/0240778 A1 10/2008 Ishikawa et al.
2013/0051816 A1 2/2013 Itabashi

FOREIGN PATENT DOCUMENTS

JP 2008-242267 A 10/2008
JP 2010-204384 A 9/2010
JP 2013-054053 A 3/2013

OTHER PUBLICATIONS

International Search Report and Written Opinion issued in related International Patent Application No. PCT/JP2017/034290, dated Nov. 21, 2017.

* cited by examiner

*Primary Examiner* — Hoan Tran
(74) *Attorney, Agent, or Firm* — Merchant & Gould P.C.

(57) ABSTRACT

A developing cartridge has a casing accommodating toner therein; a developing roller rotatable about a first axis extending an axial direction; a cam electrically connected to the developing roller and rotatable about a second axis extending the axial direction from a first position to a second position, the cam being positioned at a third position distant from the casing by a first distance in the axial direction at the first position, and the cam being positioned at a fourth position distant from the casing by a second distance at the second position in the axial direction, the second distance being greater than the first distance; and a gear rotatable about the second axis, the gear engaging with the cam in a case where the cam is at the first position, and the gear disengaging from the cam in a case where the cam is at the second position.

20 Claims, 9 Drawing Sheets

DEVELOPING CARTRIDGE CAPABLE OF DETECTING SPECIFICATION THEREOF

CROSS REFERENCE TO RELATED APPLICATION

This application claims priority from Japanese Patent Application No. 2016-256209 filed Dec. 28, 2016. The entire content of the priority application is incorporated herein by reference.

TECHNICAL FIELD

The present disclosure relates to a developing cartridge including a developing roller.

BACKGROUND

There is conventionally known a developing cartridge including a developing roller. The developing cartridge is attachable to and detachable from an image forming apparatus.

Prior art discloses a developing cartridge including a developing roller and an electrode electrically connected to the developing roller. The electrode includes a shaft contactable with a power supply portion of the image forming apparatus. The developing cartridge further includes a gear rotatable about the shaft, and a protrusion positioned at the gear. The protrusion is circularly movable together with the rotation of the gear, and is in contact with an actuator of the image forming apparatus. The actuator moves by the contact with the protrusion. The image forming apparatus detects the movement of the actuator to determine specification of the developing cartridge.

SUMMARY

There is a demand to provide a single component capable of performing the above-described functions of the electrode and the protrusion.

In view of the foregoing, it is an object of the disclosure to provide a developing cartridge capable of detecting specification of the developing cartridge by making use of a component in electrical contact with the developing roller.

In order to attain the above and other objects, according to one aspect, the disclosure provides a developing cartridge comprising: a casing configured to accommodate toner therein; a developing roller configured to rotate about a first axis extending an axial direction; a cam electrically connected to the developing roller and rotatable about a second axis extending the axial direction from a first position to a second position in a rotating direction, the cam being positioned at a third position distant from the casing by a first distance in axial direction in a case where the cam is at the first position, and the cam being positioned at a fourth position distant from the casing by a second distance in a case where the cam is at the second position in axial direction, the second distance being greater than the first distance; and a gear rotatable about the second axis, the gear engaging with the cam in a case where the cam is at the first position, and the gear disengaging from the cam in a case where the cam is at the second position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

A developing cartridge 1 according to one embodiment will be described with reference to FIGS. 1 through 8B. The developing cartridge 1 includes a casing 11, a developing roller 12 rotatable about a first axis X1, a supply roller (not illustrated), an agitator (not illustrated), and a coupling 13. The casing 11 accommodates therein toner. In the following description, an extending direction of the first axis X1 and a second axis X2 (described later) will also be referred to as an "axial direction".

The developing roller 12 is configured to supply toner to an electrostatic latent image formed on a photosensitive body (not illustrated). The developing roller 12 includes a shaft 12A extending in the axial direction and made from metal.

The supply roller is configured to supply toner to the developing roller 12. The agitator is configured to agitate toner accommodated in the casing 11.

The coupling 13 is configured to receive a driving force from an outside. Specifically, the image forming apparatus (not illustrated) includes a housing (not illustrated) and an input member (not illustrated). The input member is movable in an advancing direction or a retracting direction. The input member moving in the advancing direction engages with the coupling 13 in a rotational direction of the coupling 13, so that the driving force is transmitted from the input member to the coupling 13. The driving force is then transmitted to the developing roller 12, the supply roller, and the agitator through a gear mechanism (not illustrated).

Figure 1:
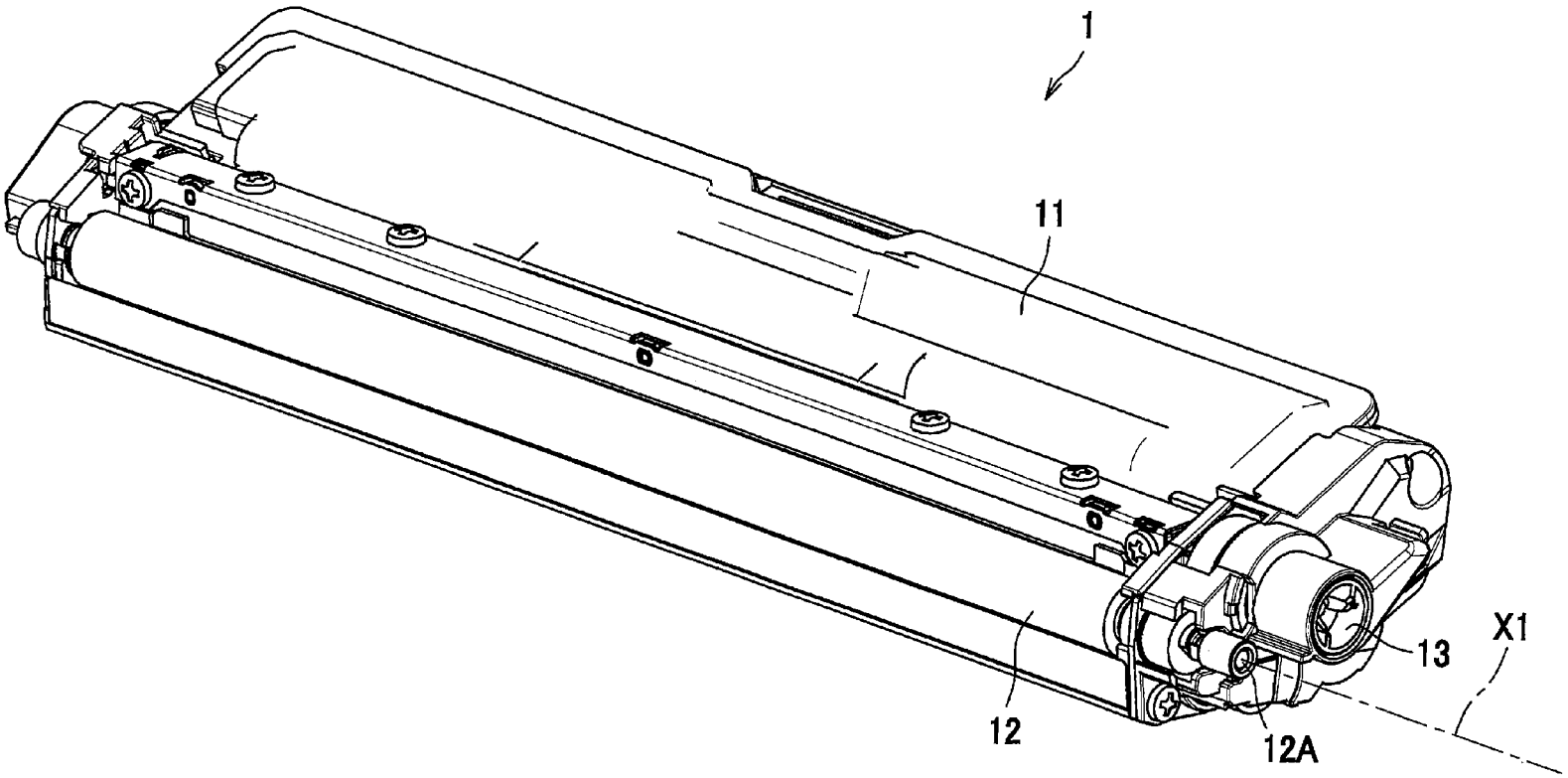
FIG. 1 is a perspective view of a developing cartridge according to one embodiment as viewed from one side in an axial direction of the developing cartridge.
Figure 2:
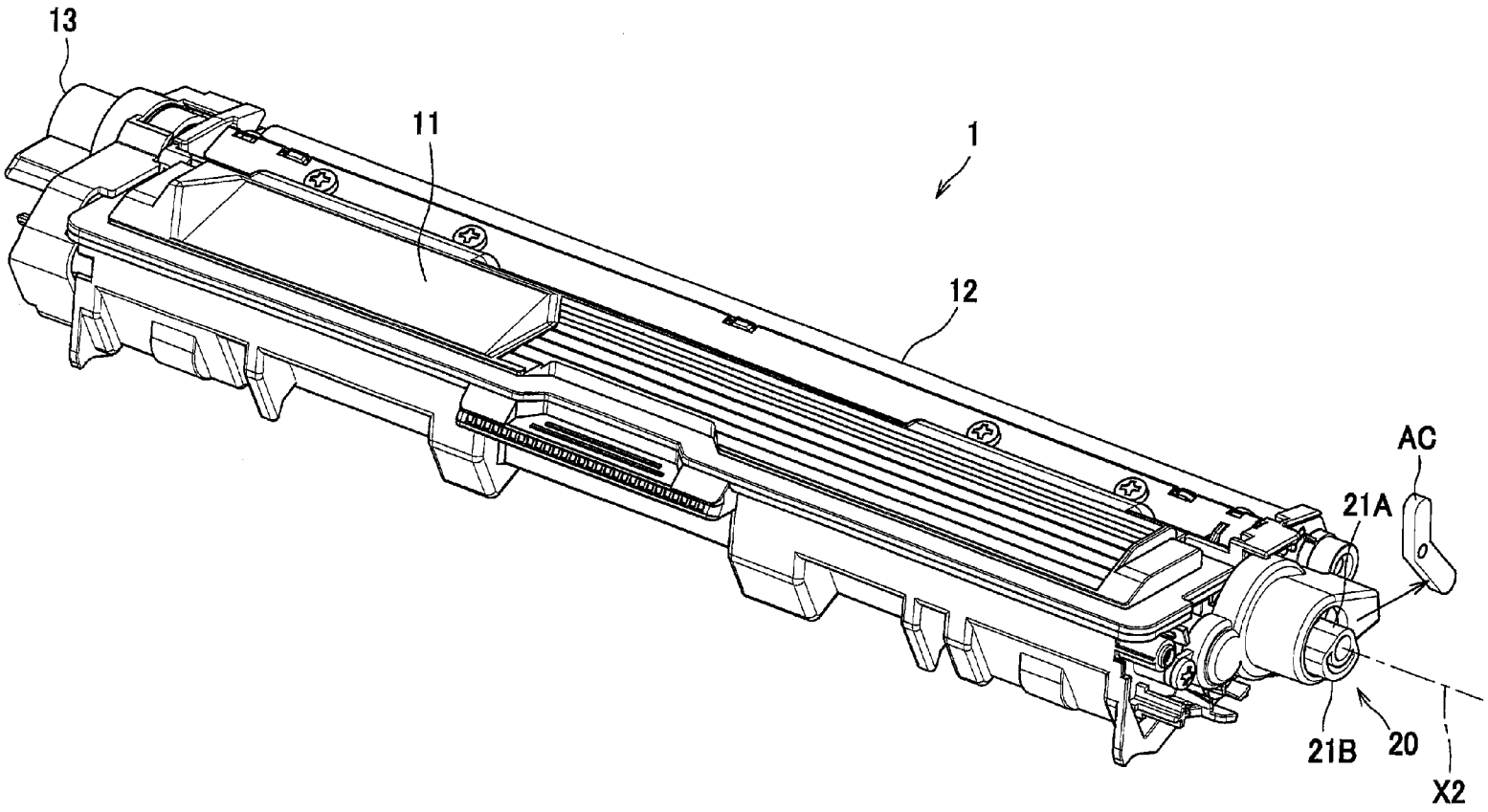
FIG. 2 is a perspective view of the developing cartridge according to the embodiment as viewed from another side in the axial direction of the developing cartridge.

The coupling 13 is positioned at one side of the casing 11 in the axial direction. As illustrated in FIG. 2, a cam 20 is positioned at another side of the casing 11 in the axial direction. In other words, the coupling 13 is positioned opposite to the cam 20 relative to the casing 11. That is, the coupling 13 is positioned at one side wall of the casing 11, and the cam 20 is positioned at another side wall 11A of the casing 11 opposite to the one side wall.

The cam 20 is configured to move an actuator AC of the housing. The actuator AC is pivotally movably supported to the housing, and is made from an electrically conductive material. The housing includes a power supply portion for supplying electric power to the actuator AC, and an optical sensor for detecting pivotal movement of the actuator AC.

The cam 20 is rotatable about the second axis X2 from a first position to a second position by the driving force received in the coupling 13 and transmitted through the gear mechanism and the agitator. That is, the driving force received in the coupling 13 is transmitted from one side to the other side of the casing 11 in the axial direction through a shaft of the agitator. The second axis X2 is parallel to the first axis X1.

Figure 3:
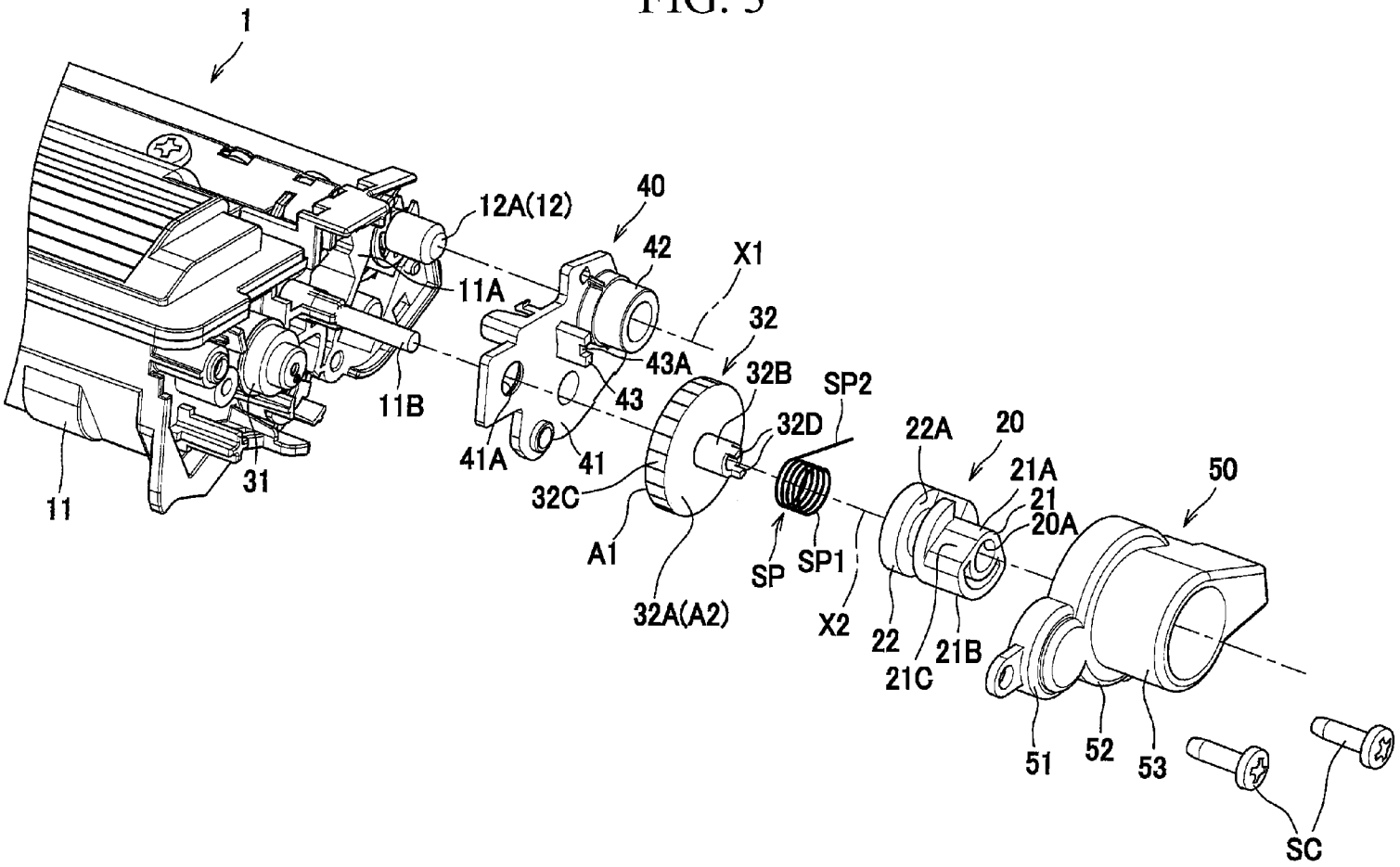
FIG. 3 is an exploded perspective view of the developing cartridge according to the embodiment, and particularly illustrating parts and components at the other end portion of the developing cartridge.

As illustrated in FIG. 3, an agitator gear 31, an idle gear 32 as an example of a gear, a bearing 40, a compression coil spring SP as an example of a spring, and a gear cover 50 are positioned in addition to the cam 20 at the other side of the casing 11 in the axial direction. The casing 11, the agitator gear 31, the idle gear 32, and the gear cover 50 are made from electrically non-conductive resin.

The cam 20, the bearing 40, and the compression coil spring SP are made from electrically conductive material. Specifically, the cam 20 and the bearing 40 are made from electrically conductive resin such as for example, polyacetal resin containing carbon powder. The compression coil spring SP is made from metal.

The agitator gear 31 is fixed to the other end portion of the agitator shaft. The agitator gear 31 is rotatable along with the agitator shaft.

Figure 4:
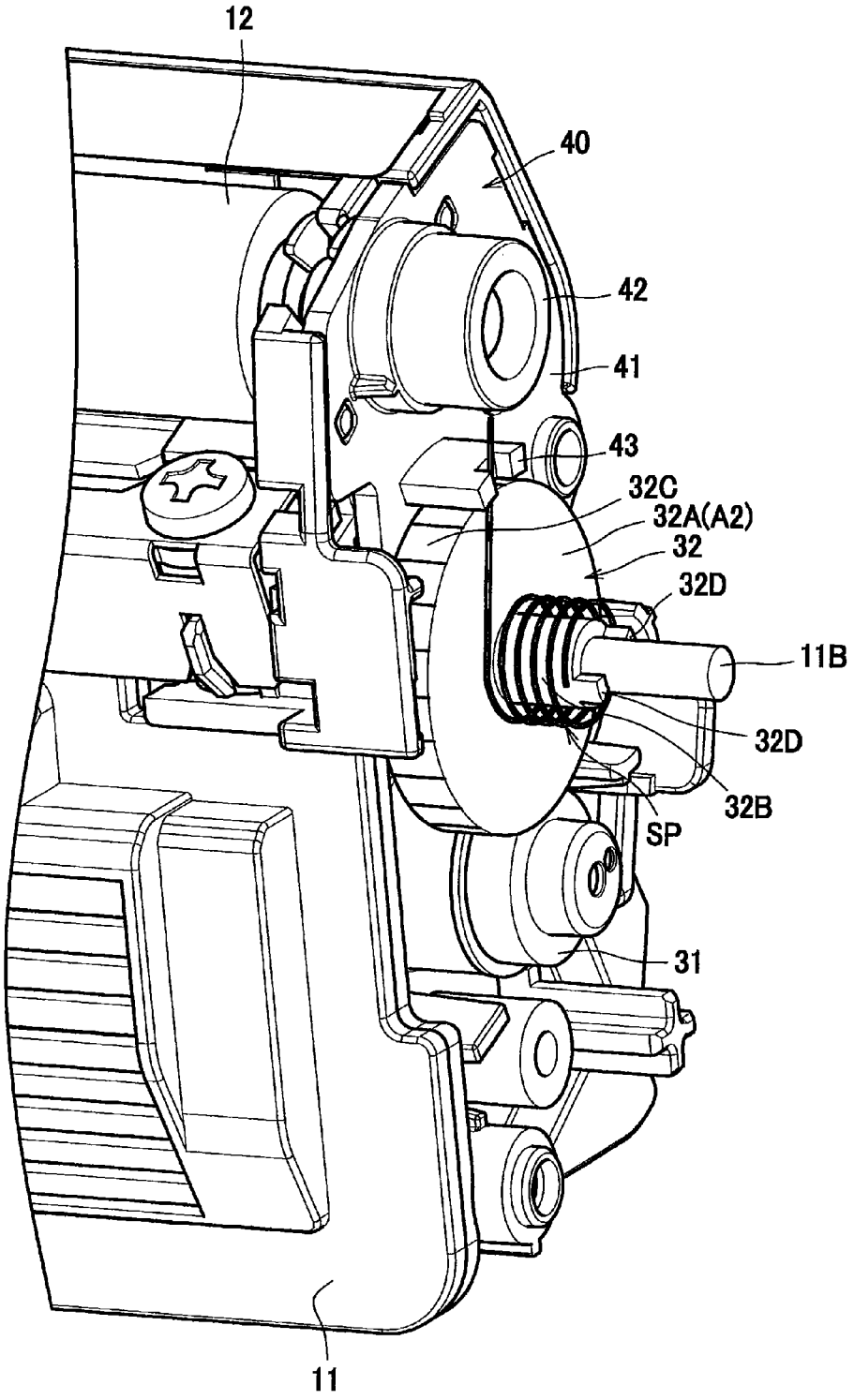
FIG. 4 is a perspective view of the developing cartridge according to the embodiment, and particularly illustrating a bearing, and idle gear, etc. those assembled to a casing of the developing cartridge.

A boss 11B extends from the side wall 11A of the casing 11 in the axial direction and away from the side wall 11A, and the idle gear 32 is rotatably supported to the boss 11B (see FIG. 4). The idle gear 32 is rotatable about the second axis X2. The idle gear 32 is positioned between the agitator gear 31 and the developing roller 12. The idle gear 32 has a diameter greater than a diameter of the agitator gear 31. The idle gear 32 includes a gear wheel portion 32A, a rotation shaft 32B, and gear teeth 32C. The gear wheel portion 32A is a disc like shape having a center coincident with the second axis X2. The gear teeth 32C is positioned at an entire circumference of the gear wheel portion 32A. The rotation shaft 32B extends from the gear wheel portion 32A in the axial direction and away from the side wall 11A. The rotation shaft 32B is hollow cylindrical.

As illustrated in FIG. 4, the gear teeth 32C of the idle gear 32 is in meshing engagement with the agitator gear 31. Thus, the idle gear 32 is rotatable together with the developing roller 12 by the driving force received in the coupling 13. The rotation shaft 32B has a distal end opposite to the gear wheel portion 32A in the axial direction, and two protrusions 32D protrude from the distal end. Two protrusions 32D are positioned at diametrically opposite sides relative to the second axis X2. The cam 20 has engagement grooves 22D (see FIG. 5). Each protrusion 32D is contactable with each engagement groove 22D in the rotational direction of the idle gear 32 in an engagement state where the each protrusion 32D is positioned in each engagement groove 22D.

As illustrated in FIG. 3, the bearing 40 is configured to rotatably support the shaft 12A of the developing roller 12, and is electrically connected to the shaft 12A of the developing roller 12. The bearing 40 includes a base 41, a bearing portion 42, and a support portion 43.

The base 41 is a plate-like member extending in a direction perpendicular to the axial direction. Specifically, the base 41 extends in length to cross the shaft 12A of the developing roller 12 and the boss 11B. The base 41 has a through-hole 41A through which the boss 11B extends. The base 41 is positioned between the side wall 11A of the casing 11 and the idle gear 32 in the axial direction.

The bearing portion 42 is hollow cylindrical to rotatably support the shaft 12A of the developing roller 12. The bearing portion 42 protrudes from the base 41 in the axial direction and away from the side wall 11A. The base 41 has a hole corresponding to an inner peripheral surface of the bearing portion 42. The hole of the base 41 is configured to rotatably support the shaft 12A of the developing roller 12 in cooperation with the bearing portion 42.

The support portion 43 is configured to support an arm SP2 (described later) of the compression coil spring SP. The support portion 43 is positioned at the base 41. The support portion 43 protrudes from the base 41 in the axial direction and away from the side wall 11A. The support portion 43 is positioned between the bearing portion 42 and the through-hole 41A. The support portion 43 has a distal end face positioned opposite to the base 41 (the casing 11) in the axial direction. Further, the idle gear 32 includes a surface A1 facing the bearing 40 and an opposite surface A2 opposite to the surface A1. Here, the distal end face of the support portion 43 is positioned farther from the base 41 than the opposite surface A2 is from the base 41 (see FIG. 4). The distal end face of the support portion 43 includes a groove 43A. The arm SP2 (described later) of the compression coil spring SP is positioned at the groove 42A.

The compression coil spring SP is positioned between the cam 20 and the gear wheel portion 32A of the idle gear 32 in the axial direction. The compression coil spring SP is configured to urge the cam 20 in the axial direction and away from the side wall 11A. That is, the compression coil spring SP is configured to urge the cam 20 in the direction away from the idle gear 32.

The compression coil spring SP includes a coil portion SP1, and the arm SP2 extending from the coil portion SP1 in a direction crossing the axial direction. The coil portion SP1 is mounted to the rotation shaft 32B so as to surround an outer peripheral surface of the rotation shaft 32B of the idle gear 32. That is, the rotation shaft 32B is positioned in an internal space of the coil portion SP1. The coil portion SP1 has one end in the axial direction seated on the cam 20.

The arm SP2 extends radially outwardly of the coil portion SP1 from another end of the coil portion SP1. The arm SP2 has a tip end portion (another end portion of the compression coil spring SP) in contact with the support portion 43 of the bearing 40. Hence, the cam 20 is in electrical contact with the developing roller 12 through the compression coil spring SP and the bearing 40.

Figure 5:
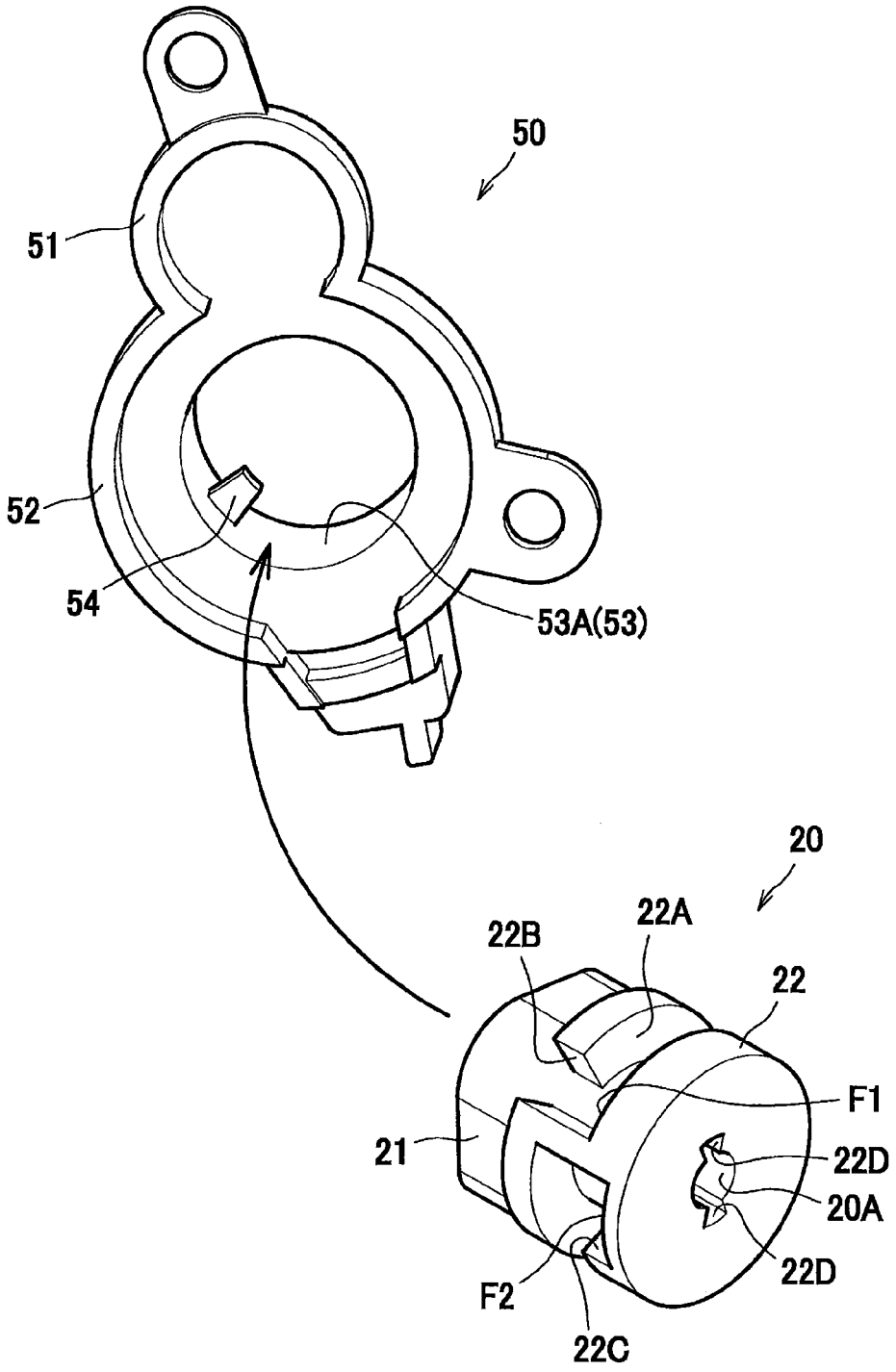
FIG. 5 is a perspective view of a cam and a gear cover in the developing cartridge according to the embodiment.

The gear cover 50 is configured to cover a portion of the idle gear 32 and the agitator gear 31. The gear cover 50 is fixed to the casing 11 by screws SC. The gear cover 50 includes a small diameter portion 51, a large diameter portion 52 and a protruding portion 53. The small diameter portion 51 covers the agitator gear 31, and the large diameter portion 52 covers the idle gear 32. The protruding portion 53 accommodates a portion of the cam 20. The protruding portion 53 protrudes from the large diameter portion 52 in the axial direction and away from the side wall 11A. The protruding portion 53 is hollow cylindrical. The cam 20 has an end face opposite to the gear wheel portion 32A in the axial direction, and the end face of the cam 20 is positioned farther from the gear wheel portion 32A than the protruding portion 53 is from the gear wheel portion 32A. As illustrated in FIG. 5, the protruding portion 53 has an inner peripheral surface 53A facing the cam 20, and a protruding portion 54 protruding from the inner peripheral surface 53A toward the cam 20.

Turning back to FIG. 3, the cam 20 is rotatably mounted to the boss 11B of the casing 11. Specifically, the cam 20 has a through-hole 20A extending in the axial direction. An inner peripheral surface of the through-hole 20A is rotatably supported to the boss 11B. Thus, the cam 20 is rotatable about the second axis X2. The cam 20 includes a first part 21 having generally sector shape, and a second part 22 having generally cylindrical shape. A portion of the first part 21 is positioned outside of the gear cover 50 in the axial direction. The second part 22 is positioned at an internal space of the protruding portion 53. The compression coil spring SP is in contact with a first end face of the second part 22 in the axial direction, the first end face being a side facing the casing 11.

The first part 21 protrudes from a second end face of the second part 22 in the axial direction, the second end face being opposite to the first end face. The first part 21 has a first arcuate surface 21A and a second arcuate surface 21B those extending in a rotational direction of the cam 20. A first length is defined between the first arcuate surface 21A and the second axis X2. A second length is between the second arcuate surface 21B and the second axis X2. The second length is greater than the first length. The first part 21 also has two planar surfaces 21C each extending between each end of the first arcuate surface 21A and each end of second arcuate surface 21B. One of the planar surfaces 21C positioned upstream of the first arcuate surface 21A and positioned downstream of the second arcuate surface 21B in the rotational direction of the cam 20 functions as a cam surface for urging the actuator AC.

The second part 22 has a diameter smaller than a diameter of the idle gear 32. The second part 22 has a radius approximately equal to the second length. The second part 22 has an outer peripheral surface. The outer peripheral surface has a C-shaped guide groove 22A extending in the rotational direction of the cam 20. The guide groove 22A is open at a radially outer end. The second part 22 also has the two engagement grooves 22D.

As illustrated in FIG. 5, the guide groove 22A has one end portion and another end portion those positioned at the same position in the axial direction. A first groove 22B is connected to the one end portion of the guide groove 22A, and a second groove 22C is connected to the other end portion of the guide groove 22A. The guide groove 22A has one side surface F1 closer to the casing 11 than another side surface is to the casing 11 in the axial direction. The one side surface F1 functions as a first contact surface F1 in contact with the protruding portion 54 of the gear cover 50 in the axial direction.

The first groove 22B extends from the one end portion of the guide groove 22A in the axial direction and away from the side wall 11A. The first groove 22B is open radially outward, and is also open to a side opposite to the casing 11 in the axial direction. The first groove 22B functions as an insertion opening allowing the protruding portion 54 of the gear cover 50 to be directed into the guide groove 22A during assembly.

The second groove 22C extends from the other end portion of the guide groove 22A in the axial direction and toward the casing 11. The second groove 22C is open radially outward, but is not open to the casing 11 in the axial direction. The second groove 22C has an end surface F2 closer to the casing 11 than another end connected to the guide groove 22A is to the casing 11 in the axial direction. The end surface F2 functions as a second contact surface F2 contactable with the protruding portion 54 of the gear cover 50 in the axial direction. The position of the second contact surface F2 is different from the position of the first contact surface F1 in axial direction and the rotational direction of the cam 20. Specifically, the second contact surface F2 is closer to the casing 11 than the first contact surface F1 is to the casing 11 in the axial direction.

Each engagement groove 22D extends toward the first part 21 in the axial direction from the end face of the second part 22. Each engagement groove 22D is engageable with each of the two protrusions 32D (FIG. 3) of the idle gear 32. Each engagement groove 22D is positioned at radially outer side of the through-hole 20A, and is connected to the through-hole 20A. Each engagement groove 22D is positioned so as to correspond to the position of each protrusion 32D of the idle gear 32.

Figure 6A:
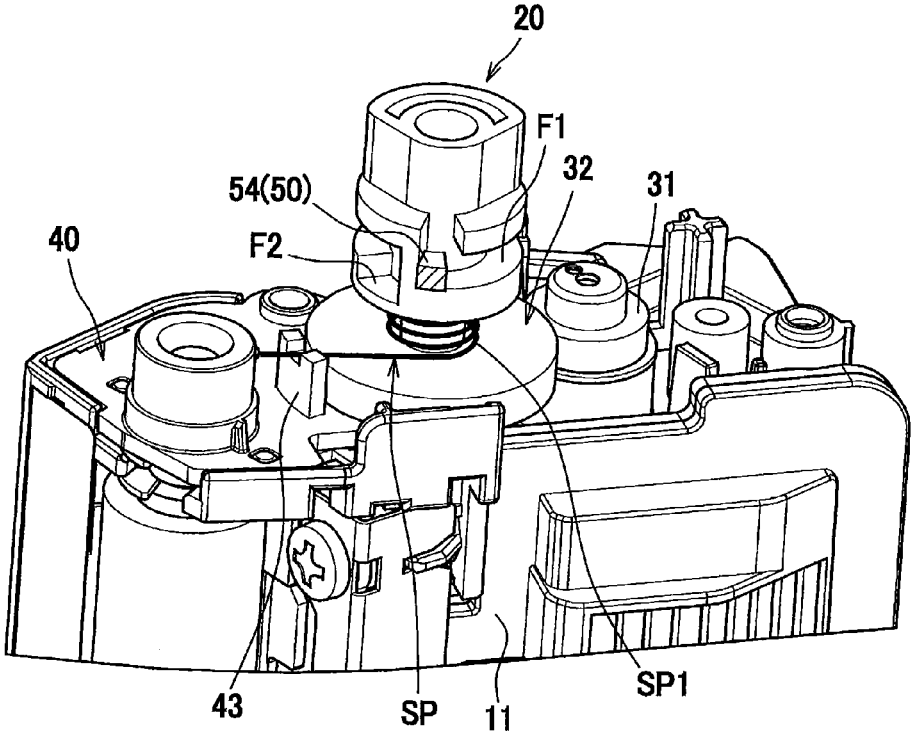
FIG. 6A is a perspective view for description of a relationship between a protruding portion of the gear cover and each contact surface of the cam in the developing cartridge according to the embodiment, and particularly illustrating an initial state of the cam.
Figure 8A:
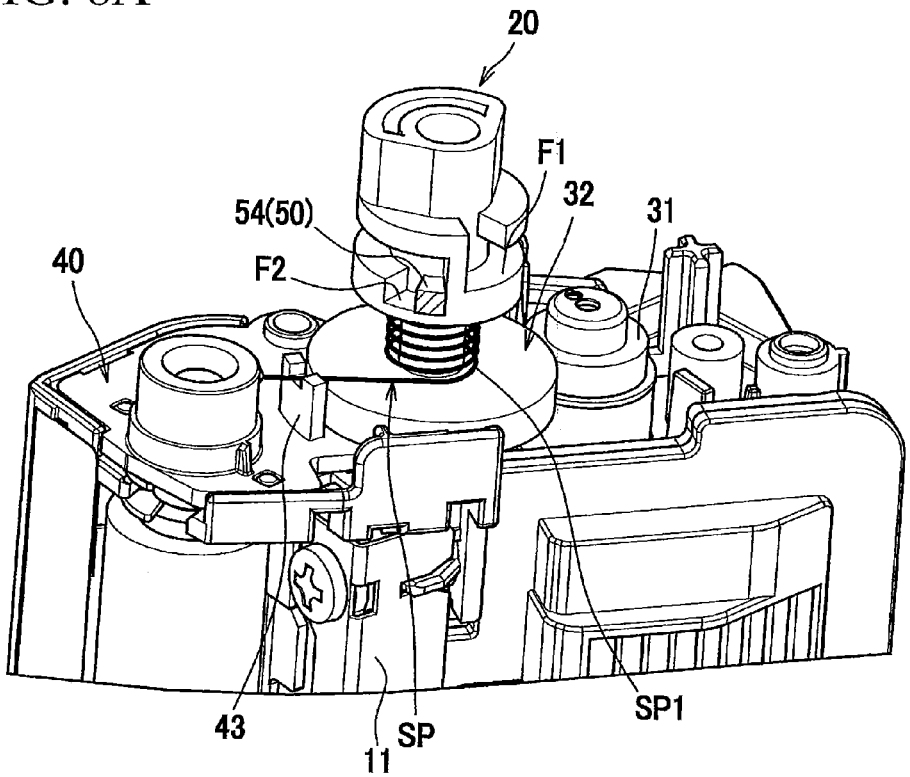
FIG. 8A is a perspective view illustrating a state where the cam is moved from a third position to a fourth position.
Figure 8B:
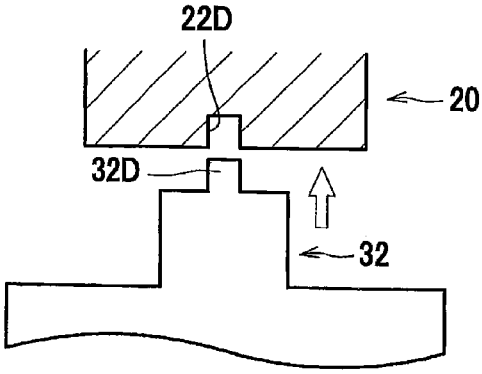
FIG. 8B is a cross-sectional view illustrating the engaging state between the protrusion of the idle gear and the engagement groove of the cam in the developing cartridge according to the embodiment, and in the state of FIG. 8A.

With the cam 20 thus constructed, the cam 20 is rotatable in the rotational direction from the first position illustrated in FIG. 6A to the second position illustrated in FIG. 8A. In a state where the cam 20 is at the first rotational position, the cam 20 is positioned at a third position where a first distance from the casing 11 to the cam 20 in the axial direction. In a state where the cam 20 is at the second rotational position, the cam 20 is positioned at a fourth position where a second distance from the casing 11 to the cam 20 in the axial direction. The second distance is greater than the first distance. That is, in accordance with the rotational movement of the cam 20 from the first position to the second position, the cam 20 moves in the axial direction from the third position to the fourth position.

Figure 6B:
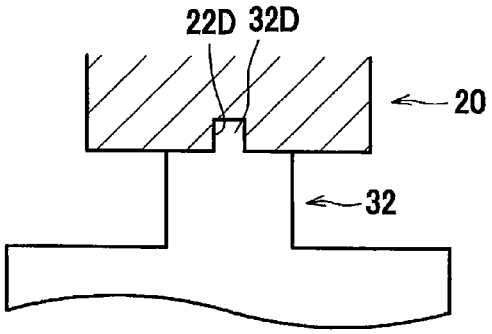
FIG. 6B is a cross-sectional view illustrating an engaging state between a protrusion of the idle gear and an engagement groove of the cam in the developing cartridge according to the embodiment and in the state of FIG. 6A.

Specifically, as illustrated in FIG. 6A, in a state where the cam 20 is at the third position (at the first rotational position), the protruding portion 54 of the gear cover 50 is in contact with the first contact surface F1 in the axial direction. Further, in a state where the cam 20 is at the third position (at the first rotational position), the idle gear 32 is at an engaging state where the protrusion 32D of the idle gear 32 engages with the engagement groove 22D of the cam 20 as illustrated in FIG. 6B. Therefore, at the third position of the cam 20, driving force can be transmitted from the idle gear 32 to the cam 20.

As illustrated in FIG. 8A, in a state where the cam 20 is at the fourth position (at the second rotational position), the protruding portion 54 of the gear cover 50 is in contact with the second contact surface F2 in the axial direction. Further, in a state where the cam 20 is at the fourth position (at the second rotational position), the engagement groove 22D disengages from the protrusion 32D of the idle gear 32, because the engagement groove 22D moves in a direction away from the side wall 11A. Therefore, the idle gear 32 becomes a disengaged state where the idle gear 32 disengages from the cam 20. Thus, at the fourth position of the cam 20, transmission of the driving force from the idle gear 32 to the cam 20 is shut off.

Further, at the third position of the cam 20 (first rotational position of the cam 20), the compression coil spring SP is at a first state where the compression coil spring SP has a first spring length in the axial direction. At the fourth position of the cam 20 (second rotational position of the cam 20), the compression coil spring SP is at a second state where the compression coil spring SP has a second spring length in the axial direction greater than the first spring length. At the fourth position of the cam 20 (second rotational position of the cam 20), the second spring length is smaller than a natural length of the compression coil spring SP in the axial direction.

The next description will explain the operation of each of parts constituting the developing cartridge 1.

As illustrated in FIG. 2, the first arcuate surface 21A of the cam 20 is brought into contact with the electrode of the actuator AC in a case where the new developing cartridge 1 is attached to the housing of the image forming apparatus. Further, the first arcuate surface 21A pushes the actuator AC, so that the actuator AC pivotally moves from the first pivot position to the second pivot position.

The optical sensor detects displacement of the actuator AC from the first pivot position to the second pivot position. Hence, a controller of the housing of the image forming apparatus determines that the developing cartridge 1 is attached to the housing.

Thereafter, upon input of the driving force from the drive source of the housing to the coupling 13 of the developing cartridge 1, the driving force is transmitted from the coupling 13 to the shaft of the agitator through the gear mechanism. The driving force transmitted to the shaft of the agitator is then transmitted to the idle gear 32 through the agitator gear 31, as illustrated in FIG. 6A.

Figure 7:
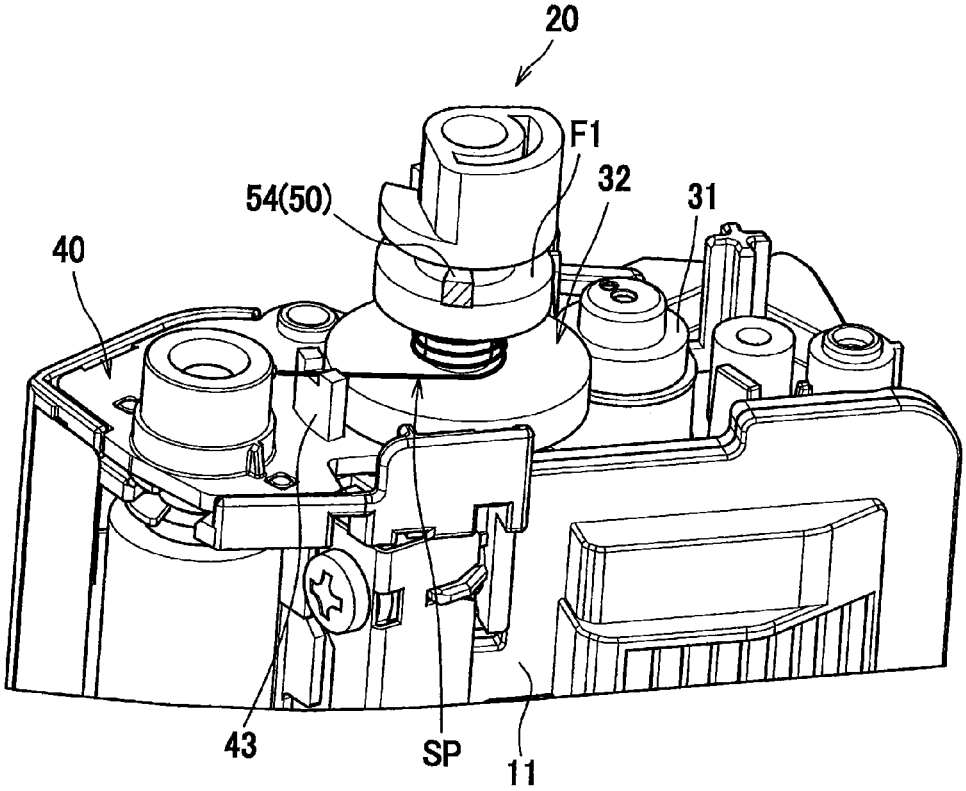
FIG. 7 is a perspective view illustrating a state of slight rotation of the cam after the initial state in the developing cartridge according to the embodiment.

By the rotation of the idle gear 32, the driving force is transmitted from the protrusion 32D to the engagement groove 22D as illustrated in FIG. 6B. Hence, the cam 20 rotates along with the idle gear 32 as illustrated in FIG. 7.

By the rotation of the cam 20, the actuator AC is pressed by the planar surface 21C of the cam 20, so that the actuator AC pivotally moves from the second pivot position toward a third pivot position. The actuator AC is at the third pivot position upon contact of the second arcuate surface 21B of the cam 20 with the actuator AC. The optical sensor detects displacement of the actuator AC from the second pivot position to the third pivot position. Thus, the controller determines that the developing cartridge 1 is the new cartridge.

During rotation of the cam 20, the protruding portion 54 moves relative to the cam 20 while sliding on the first contact surface F1 and gradually approaches the second contact surface F2. Then, as illustrated in FIG. 8A, the cam 20 moves in the direction away from the idle gear 32 in the axial direction from the third position to the fourth position upon disengagement of the protruding portion 54 from the first contact surface F1. Specifically, upon disengagement of the protruding portion 54 from the first contact surface F1, the cam 20 moves in the direction away from the side wall 11A in the axial direction by the biasing force of the compression coil spring SP. Then, the movement of the cam 20 stops at the fourth position upon contact of the protruding portion 54 with the second contact surface F2. The protrusion 32D disengages from the engagement groove 22D by the movement of the cam 20 in the axial direction.

In this instance, the cam 20 rotates by generally 360 degrees from the initial state, so that the first arcuate surface 21A again supports the actuator AC. That is, after the shut off state of the power transmission to the cam 20, the actuator AC is at the second pivot position. Accordingly, the actuator AC can be displaced from the first pivot position to the second pivot position in a case where the developing cartridge 1 already used is again attached to the housing. Consequently, the controller can determine whether or not the developing cartridge 1 is attached to the housing.

The developing cartridge 1 according to the above-described embodiment provides the effects as follows: The actuator AC can be operated by the cam 20 rotated by the power transmission from the idle gear 32 from the first rotational position to the second rotational position. Thus, specification of the developing cartridge 1, such as whether the developing cartridge 1 is a new cartridge can be detected. Further, the actuator AC can be desirably operated, since transmission of the driving force to the cam 20 is shut off by the movement of the cam from the third position to the fourth position. Further, electric power supplied to the electrode provided at the actuator AC can be supplied to the developing roller 12 through the cam 20, since the cam 20 is made from electrically conductive material and is electrically connected to the developing roller 12.

Further, the cam 20 can desirably move from the third position to the fourth position because of the provision of the compression coil spring SP for urging the cam 20 in the direction away from the idle gear 32.

Further, electric power can be supplied to the developing roller 12 through the cam 20, the compression coil spring SP, and the bearing 40, since the compression coil spring SP is in contact with the cam 20 and the bearing 40.

Further, a space between the cam 20 and the idle gear 32 can be effectively utilized for the layout of the compression coil spring SP, since the compression coil spring SP is positioned between the cam 20 and the idle gear 32 in the axial direction.

Further, the cam 20 can be easily produced, since the cam 20 is made from the electrically conductive resin.

Various modifications may be conceivable. In the following description, like parts and components are designated by the same reference numerals as those shown in the above-described embodiment, and their detailed explanations will be omitted.

Figure 9A:
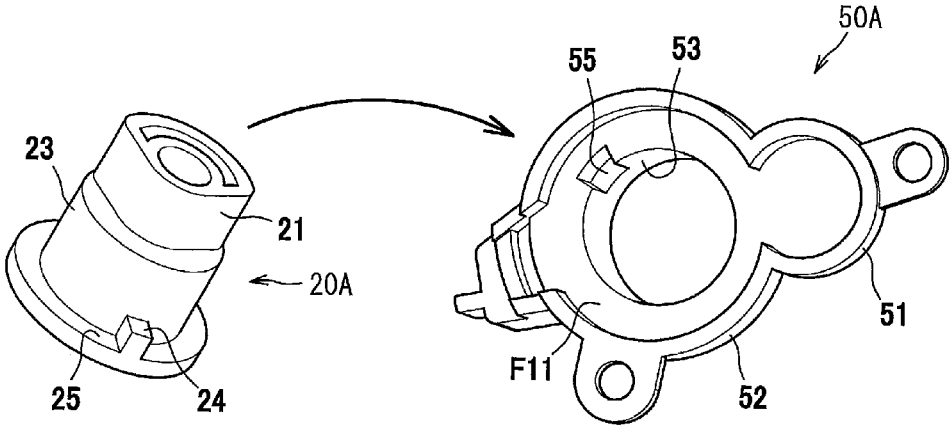
FIG. 9A is a perspective view of a cam and a gear cover in a developing cartridge according to one modification.

According to the above-described embodiment, the protruding portion 54 is positioned at the gear cover 50, and the first contact surface F1 is positioned at the cam 20. However, as illustrated in FIG. 9A according to one modification, a protrusion 24 can be positioned at a cam 20A, and a first contact surface F11 can be positioned at a gear cover 50A.

More specifically, according to the modification, the cam 20A includes the first part 21 similar to the first part 21 of the above-described embodiment, and a second part 23 different from the second part 22 of the above-described embodiment. The second part 23 includes the protrusion 24 and a flange 25 instead of formation of the above-described grooves 22A, 22B, and 22C.

The flange 25 protrudes radially outwardly from an end portion of the second part 23 in the axial direction, and the end portion faces the casing 11. The protrusion 24 protrudes from the flange 25 in the axial direction and away from the side wall 11A, and protrudes radially outwardly from an outer peripheral surface of the second part 23.

The gear cover 50A includes a first contact surface F11 and a recessed portion 55. The first contact surface F11 contacts the protrusion 24 at the third position of the cam 20.

The recessed portion 55 is recessed from the first contact surface F11 in a direction away from the side wall 11A in the axial direction. The recessed portion 55 is open toward the casing 11 in the axial direction and is also open radially inwardly. The recessed portion 55 has a depth in the axial direction greater than a protruding length of the protrusion 24 from the flange 25.

Figure 9B:
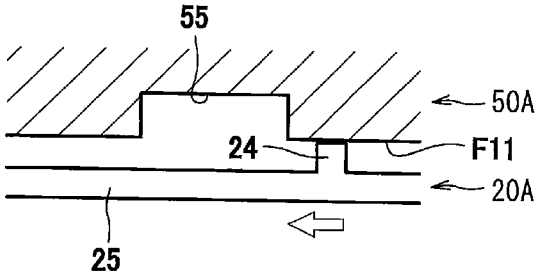
FIG. 9B is a cross-sectional view illustrating a relationship between a protruding portion and a first contact surface in the developing cartridge according to the modification.
Figure 9C:
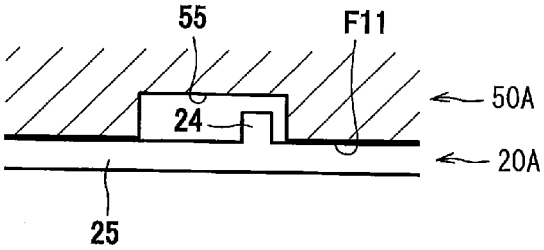
FIG. 9C is a cross-sectional view illustrating the relationship between the protruding portion and the first contact surface in the developing cartridge according to the modification and in a state after the state of FIG. 9B.

According to the modification, as illustrated in FIG. 9B, the protrusion 24 of the cam 20 moves while sliding on the first contact surface F11 of the gear cover 50A by the rotation of the cam 20 positioned at the third position. As illustrated in FIG. 9C, the cam 20 moves in the direction away from the side wall 11A in the axial direction by the urging force of the compression coil spring SP after the protrusion 24 moves past the first contact surface F11. Thus, the flange 25 contacts with the first contact surface F11. Accordingly, the cam 20 is positioned at the fourth position.

Further, according to the above-described embodiment, an entirety of the compression coil spring SP is positioned between the cam 20 and the idle gear 32 in the axial direction. However, a portion of the spring may be positioned between the cam 20 and the idle gear 32 in the axial direction. Further, a leaf spring and a torsion spring are available instead of the compression coil spring.

Further, according to the above-described embodiment, the idle gear 32 in meshing engagement with the agitator gear 31 is exemplified as the gear. However, any kind of gears may be available. Further, a toothless friction wheel performing power transmission to a neighboring component by frictional force is also available.

Further, according to the above-described embodiment, the protrusion 32D is positioned at the idle gear 32, and the engagement groove 22D is positioned at the cam 20. However, a protrusion may be positioned at the cam, and an engagement groove engageable with the protrusion in the rotational direction may be positioned at the gear.

Further, according to the above-described embodiment, the portion of the idle gear 32 is covered with the gear cover 50. However, an entirety of the idle gear may be covered with the gear cover.

Further, each part and component appearing in the above-described embodiment and the modification may be suitably combined together.

While the description has been made in detail with reference to the embodiments thereof, it would be apparent to those skilled in the art that many modifications and variations may be made therein without departing from the spirit of the disclosure.

What is claimed is:

1. A developing cartridge comprising:

a casing configured to accommodate toner therein;

a developing roller rotatable about a first axis extending an axial direction;

a cam electrically connected to the developing roller and rotatable about a second axis extending the axial direction from a first position to a second position in a rotating direction, the cam being positioned at a third position distant from the casing by a first distance in the axial direction in a case where the cam is at the first position, and the cam being positioned at a fourth position distant from the casing by a second distance in a case where the cam is at the second position in the axial direction, the second distance being greater than the first distance; and a gear rotatable about the second axis, the gear engaging with the cam in a case where the cam is at the first position, and the gear disengaging from the cam in a case where the cam is at the second position.

2. The developing cartridge according to claim 1, further comprising a spring positioned between the cam and the gear.

3. The developing cartridge according to claim 2, wherein the spring has a first state and a second state, the first state being a state in which a length of the spring in the axial direction is a first length in a state where the cam is at the first position, and the first state being a state in which a length of the spring in the axial direction is a second length being greater than the first length in a state where the cam is at the second position.

4. The developing cartridge according to claim 3, wherein the spring has one end in the axial direction in contact with the cam.

5. The developing cartridge according to claim 4, wherein the developing roller comprises a shaft, the developing cartridge further comprising a bearing supporting the shaft and electrically connected to the shaft, wherein the spring has another end opposite to the one end in the axial direction, and the another is in contact with the bearing.

6. The developing cartridge according to claim 5, wherein the spring is a coil spring.

7. The developing cartridge according to claim 6, wherein the coil spring comprises a coil portion, and an arm extending from the coil portion in a direction crossing the axial direction, wherein the bearing comprises a support portion supporting the arm, and the support portion protruding in the axial direction.

8. The developing cartridge according to claim 7, wherein the support portion has a tip end portion opposite to the casing, the tip end portion having a groove in which the arm is positioned.

9. The developing cartridge according to claim 7, wherein the bearing further comprises a base having a plate shape, the base has a hole for supporting the shaft of the developing roller, the support portion being positioned at the base, wherein the support portion has a tip end face in the axial direction, wherein the gear has a first end face facing the bearing and a second end face opposite to the first end face, and wherein the tip end face of the support portion is positioned farther from the base than the second end face is from the base.

10. The developing cartridge according to claim 7, wherein the coil portion has a length in the axial direction at the second position of the cam, the length being smaller than a natural length of the coil portion.

11. The developing cartridge according to claim 1, wherein the gear comprises:

a gear wheel having a peripheral portion, the peripheral portion having a gear teeth;

a rotation shaft extending in the axial direction from the gear wheel, the rotation shaft having a tip end in the axial direction; and a protrusion protruding from the tip end of the rotation shaft, the protrusion contacting with the cam in a rotating direction of the gear in a state where the gear engages with the cam.

12. The developing cartridge according to claim 2, wherein the spring is a coil spring.

13. The developing cartridge according to claim 12, wherein the gear comprises:

a gear wheel having a peripheral portion, the peripheral portion having a gear teeth; and a rotation shaft extending in the axial direction from the gear wheel, the rotation shaft being positioned within an internal space of the coil spring.

14. The developing cartridge according to claim 13, wherein the rotation shaft comprises a protrusion protruding from a tip end of the rotation shaft, the protrusion contacts with the cam in a rotating direction of the gear in a state where the cam engages with the gear.

15. The developing cartridge according to claim 12, further comprising a bearing supporting a shaft of the developing roller, the spring having one end in the axial direction in contact with the cam, and another end opposite to the one end in the axial direction in contact with the bearing.

16. The developing cartridge according to claim 1, further comprising a gear cover covering at least a portion of the gear, the gear cover including a protruding portion protruding toward the cam, wherein the cam has a first contact surface and a second contact surface, the first contact surface being configured to be in contact with the protruding portion in the axial direction, the second contact surface being positioned at a position different from a position of the first contact surface in the axial direction and in a rotational direction of the cam, wherein the first contact surface is in contact with the protruding portion in a state where the cam is at the first position, and wherein the second contact surface is in contact with the protruding portion in a state where the cam is at the second position.

17. The developing cartridge according to claim 1, further comprising a coupling positioned opposite to the cam relative to the casing.

18. The developing cartridge according to claim 1, wherein the cam has a first arcuate surface and a second arcuate surface, the first arcuate surface and the second arcuate surface extend in the rotational direction of the cam, wherein a distance between the first arcuate surface and the second axis is a first length, and wherein a distance between the second arcuate surface and the second axis is a second length, being greater than the first length.

19. The developing cartridge according to claim 1, wherein the gear has gear teeth positioned at an entire peripheral surface.

20. The developing cartridge according to claim 1, wherein the cam is movable in an axial direction extending the second axis.

* * * * *